US007128056B2

(12) United States Patent
Kondo

(10) Patent No.: US 7,128,056 B2
(45) Date of Patent: Oct. 31, 2006

(54) THROTTLE BODY IN FUEL INJECTION APPARATUS

(75) Inventor: Yasushi Kondo, Kanagawa (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/247,175

(22) Filed: Oct. 12, 2005

(65) Prior Publication Data

US 2006/0081221 A1 Apr. 20, 2006

(30) Foreign Application Priority Data

Oct. 14, 2004 (JP) ..... 2004-300399

(51) Int. Cl.
*F02M 1/00* (2006.01)
*F02M 51/00* (2006.01)

(52) U.S. Cl. ..... 123/470; 123/472

(58) Field of Classification Search ..... 123/470, 123/472, 456, 468, 469
See application file for complete search history.

(56) References Cited

U.S. PATENT DOCUMENTS

| | | | | |
|---|---|---|---|---|
| 4,347,822 | A * | 9/1982 | Casey | 123/445 |
| 4,446,837 | A * | 5/1984 | Elpern | 123/460 |
| 5,203,299 | A | 4/1993 | Ueda | 123/308 |
| 5,927,254 | A * | 7/1999 | Ino et al. | 123/470 |
| 2005/0045155 | A1 * | 3/2005 | Harvey et al. | 123/470 |

* cited by examiner

*Primary Examiner*—John T. Kwon
(74) *Attorney, Agent, or Firm*—Bacon & Thomas, PLLC

(57) ABSTRACT

To improve layout freedom, waterproof and dustproof, a lower cup opening upward side is integrally formed with a throttle body and an upper cup covers the lower cup to form a chamber, a fuel injection valve is fixed to throttle body by a fuel distribution pipe, the fuel injection valve, the fuel distribution pipe and a female type connector fitted to an external connecting connector of the fuel injection valve are arranged within the chamber, a takeout groove is formed in a side wall of the upper cup toward a lower attaching collar portion, and a fuel introduction pipe connected to the fuel distribution pipe and a lead wire connected to the female type connector are drawn out to the external via the takeout groove.

2 Claims, 5 Drawing Sheets

THROTTLE BODY IN FUEL INJECTION APPARATUS

TECHNICAL FIELD

The present invention relates to a throttle body in a fuel injection apparatus in which a fuel within a fuel tank is boosted by a fuel pump and the boosted fuel is injected and supplied into a suction air passage of the throttle body via a fuel injection valve attached to the throttle body.

BACKGROUND ART

A throttle body in a conventional fuel injection apparatus is shown in FIG. 5.

FIG. 5 is a longitudinal sectional view of the throttle body along a suction air passage.

Reference numeral 1 denotes a throttle body in which a suction air passage 2 is provided so as to pass through an inner portion sideward. The suction air passage 2 is opened and closed by a butterfly type throttle valve 4 attached to a throttle valve shaft 3 rotatably supported to the throttle body 1, whereby an amount of air supplied to an engine is controlled.

A right side of the suction air passage 2 in FIG. 5 is connected to an air cleaner (not shown), and a left side of the suction air passage is connected to the engine (not shown).

A fuel injection valve J is arranged on an upper side wall of the throttle body 1 in a obliquely lower left direction, and the fuel injection valve J is shown, for example, in Japanese Unexamined Patent Publication No. 2001-193600.

The fuel injection valve J has an injection side leading end portion Ja provided with an injection hole in a leading end side, a fuel inflow side rear end portion Jb provided with a fuel inflow path supplying the fuel toward an inner portion in a rear end side, and an external connecting connector Jc supplying an electric current toward an electromagnetic coil in a side portion thereof.

Further, the injection side leading end portion Ja of the fuel injection valve J is arranged so as to be inserted into an injection valve support hole 1*a* provided in the throttle body 1, the fuel inflow side rear end portion Jb is inserted to an injection valve support hole 5*a* of a fuel distribution pipe 5, and a collar portion 5*c* of the fuel distribution pipe 5 is engaged with the throttle body 1 by a screw 6 in this state.

In accordance with the structure mentioned above, the fuel injection valve J is pinched by the throttle body 1 and the fuel distribution pipe 5, and is fixedly arranged in the throttle body 1.

Further, the fuel boosted by the fuel pump (not shown) is supplied into the fuel distribution pipe 5 by a fuel introduction pipe 7 extending to a side portion from the fuel distribution pipe 5, and the fuel is supplied toward the fuel inflow side rear end portion Jb of the fuel injection valve J via a fuel distribution pipe 5*b* provided within the fuel distribution pipe 5.

On the other hand, a female type connector 8 provided with a lead wire 8*a* connected to an ECU (not shown) is fitted and connected to the external connecting connector Jc.

Accordingly, when applying the current to the electromagnetic coil within the fuel injection valve J from the ECU via the female type connector 8 and the external connecting connector Jc, the fuel injection valve J converts an electric signal into a fuel flow rate so as to inject and supply the fuel toward an inner side of the suction air passage 2 of the throttle body 1 on the basis of an injection signal from the ECU.

DISCLOSURE OF THE INVENTION PROBLEM TO BE SOLVED BY THE INVENTION

In accordance with the conventional throttle body mentioned above, the fuel injection valve is arranged so as to be directly exposed on a sidewall of the throttle body. Accordingly, the structure is not preferable in view of the following points, particularly in a two-wheeled vehicle, a three-wheeled vehicle and a general purpose machine.

First, in order to protect the fuel injection valve and the fuel distribution pipe from an external obstacle, it is necessary to properly set a layout thereof in a lower side of the fuel tank, particularly in a vehicle such as the two-wheeled vehicle or the like having no broad attaching space. Accordingly, a lot of developing time is required for selecting the layout.

Secondly, since mud, water such as rain water, muddy water and the like, and sand directly fall on a fitted and connected portion between the external connecting connector and the female type connector 8, a lot of developing time is required for a waterproof and dustproof countermeasure.

Thirdly, the fuel injection valve generates a drive sound during an operation of the engine, and the drive sound worries a driver particularly in the two-wheeled vehicle in which the driver is positioned near the fuel injection valve, and causes a fatigue of the driver in a long time drive.

The present invention is made by taking the problem mentioned above into consideration, and an object of the present invention is to provide a throttle body in a fuel injection apparatus, which has a high freedom of layout of the throttle body provided with a fuel injection valve with respect to a vehicle, easily achieves a waterproof and a dustproof of a fitted and connected portion between an external connecting connector and a female type connector and can effectively shut off a drive sound of the fuel injection valve.

MEANS FOR SOLVING THE PROBLEM

In order to achieve the object mentioned above, in accordance with a first aspect of the present invention, there is provided a throttle body in a fuel injection apparatus in which an injection side leading end portion of a fuel injection valve provided with an external connecting connector is arranged so as to be inserted into an injection valve support hole of the throttle body, a fuel inflow side rear end portion of the fuel injection valve is arranged so as to be inserted into an injection valve support hole of a fuel distribution pipe connected to a fuel introduction pipe, the fuel injection valve is pinched by the throttle body and the fuel distribution pipe, and a female type connector provided with a lead wire connected to an external power source is fitted and connected to an external connecting connector of the fuel injection valve, wherein a closed-end cup-shaped lower cup surrounding the fuel injection valve and open to an upper side by an upper attaching collar portion is integrally provided in one side of the throttle body, and a closed-end cup-shaped upper cup open to a lower side by a lower attaching collar portion is arranged on the upper attaching collar portion in a contact manner, wherein the fuel injection valve including the female type connector fitted and connected to the external connecting connector and the fuel distribution pipe provided with a fuel introduction pipe are arranged so as to be received within a receiving chamber formed by the lower cup and the upper cut, the fuel introduction pipe and a lead wire connected to the female type connector are arranged at a position above the upper attaching collar portion of the lower cup, and wherein the lead wire and the fuel introduction pipe are drawn out of the receiving chamber via a takeout groove which is arranged in a side wall of the upper cup and formed in a notched shape open toward a lower end face of the lower attaching collar portion.

Further, in accordance with a second aspect of the present invention, in addition to the first aspect mentioned above, a plurality of the throttle bodies are arranged side by side, and the takeout grooves are open to opposing side walls of the upper cups of the adjacent throttle bodies.

EFFECT OF THE INVENTION

In accordance with the first aspect of the present invention, the fuel injection valve pinched by the throttle body and the fuel distribution pipe and the fitted and connected portion between the external connecting connector and the female type connector are arranged within the receiving chamber formed by the lower cup integrally formed with the throttle body and the upper cut covering the lower cup.

On the other hand, the fuel introduction pipe extending to the side portion from the fuel distribution pipe arranged within the receiving chamber and the lead wire extending from the female type connector are drawn out to the external portion via the takeout groove provided in the upper cup.

In accordance with the structure mentioned above, since the fuel injection valve and the fitted and connected portion between the external connecting connector and the female type connector are arranged within the receiving chamber, they do not come into collision with the external obstruct, the freedom of layout is high in the vehicle such as the two-wheeled vehicle or the like, and it is possible to properly select the layout for an extremely short time.

Further, since the fitted and connected portion between the external connecting connector and the female type connector is arranged within the receiving chamber, rain water, muddy water, mud, dust or the like neither falls on the fitted and connected portion nor is accumulated. Accordingly, it is possible to continue a stable electric connection for a long time period.

Further, since the fuel injection valve is arranged within the receiving chamber, it is possible to inhibit the drive sound generated by the fuel injection valve from leaking toward an external portion. Accordingly, it is possible to inhibit the fatigue of the driver at a time of the driving for a long time period.

Further, since the receiving chamber is formed by the lower cup integrally formed with the throttle body, and the upper cup covering the lower cup, it is possible to form an outer appearance similar to a conventional fixed vacuum type carburetor as well as it is possible to extremely simply form the receiving chamber without increasing a number of the parts. Accordingly, the structure is preferable as the throttle body for the two-wheeled vehicle in which a retro outer appearance is preferred.

Further, since the takeout groove is arranged in the side wall of the upper cup and is formed in the notched shape in a state in which the lower side is open toward the lower side attaching collar portion, it is possible to attach the upper cup toward the lower cup and arrange the fuel introduction pipe and the lead wire so as to be inserted to the takeout groove, after fitting and connecting the female type connector to the external portion connecting connector as well as fixedly arranging the fuel injection valve in the throttle body by using the fuel distribution valve. Accordingly, it is possible to improve an attaching property of the upper cup.

Further, it is possible to improve a maintenance workability of the fuel distribution pipe and the female type connector.

Further, in accordance with a second aspect of the present invention, since the takeout grooves formed in the adjacent throttle bodies are open to the facing side walls of the upper cups of the adjacent throttle bodies, it is possible to supply fuel to the fuel distribution pipes of the respective throttle bodies by using one common fuel introduction pipe. Further, since it is possible to take out the lead wires extending from the fuel injection valves attached to the respective throttle bodies between the facing surfaces of both the throttle bodies, it is possible to arrange both the lead wires into one set so as to direct to the ECU, and it is possible to neatly arrange the wiring layout.

BEST MODE FOR CARRYING OUT THE INVENTION

A description will be given of an embodiment of a throttle body in a fuel injection apparatus in accordance with the present invention with reference to the accompanying drawings.

Figure 1:
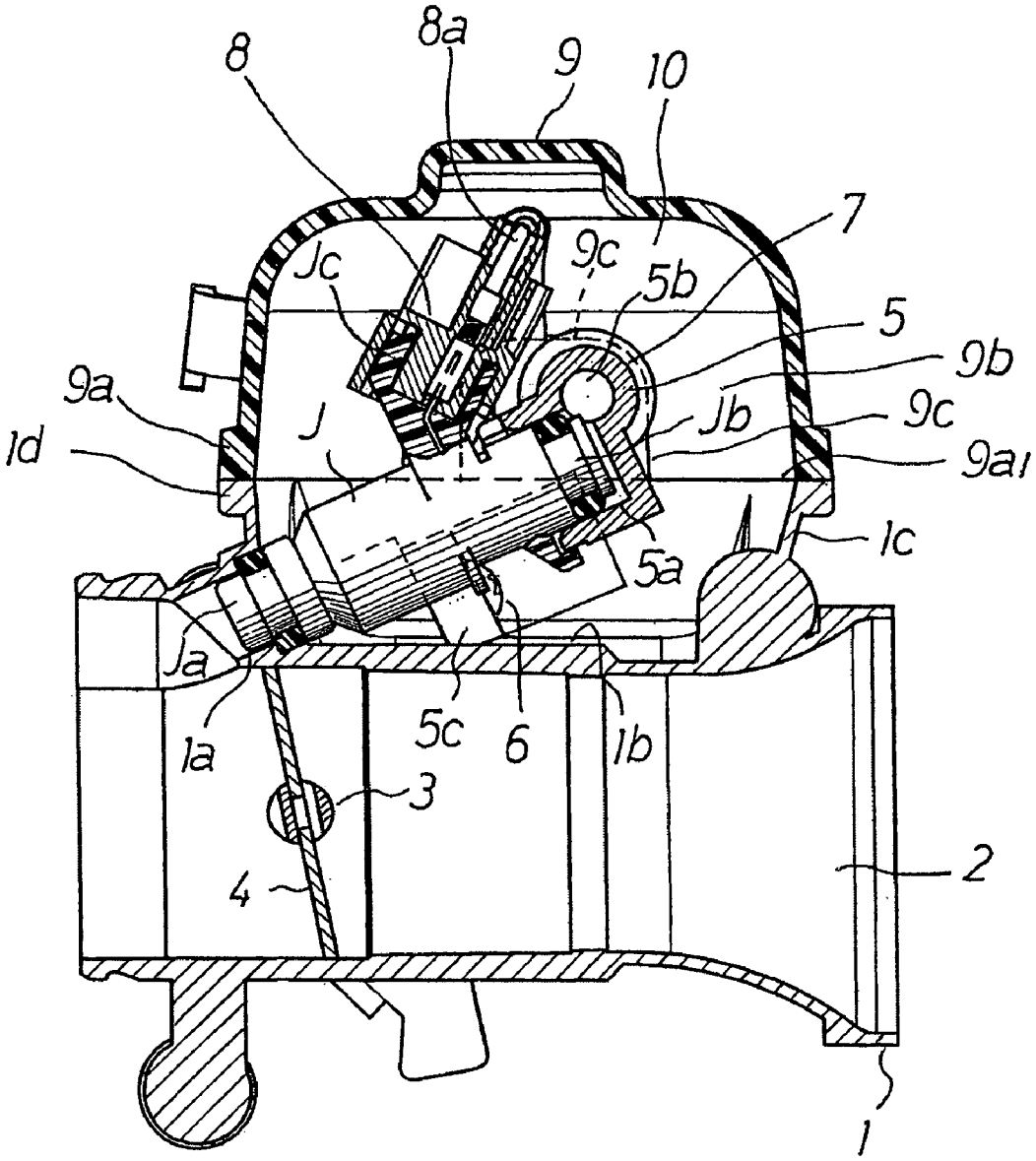
FIG. 1 is a longitudinal sectional view in a longitudinal direction of a suction air passage, and shows an embodiment of a throttle body in a fuel injection apparatus in accordance with the present invention.
Figure 2:
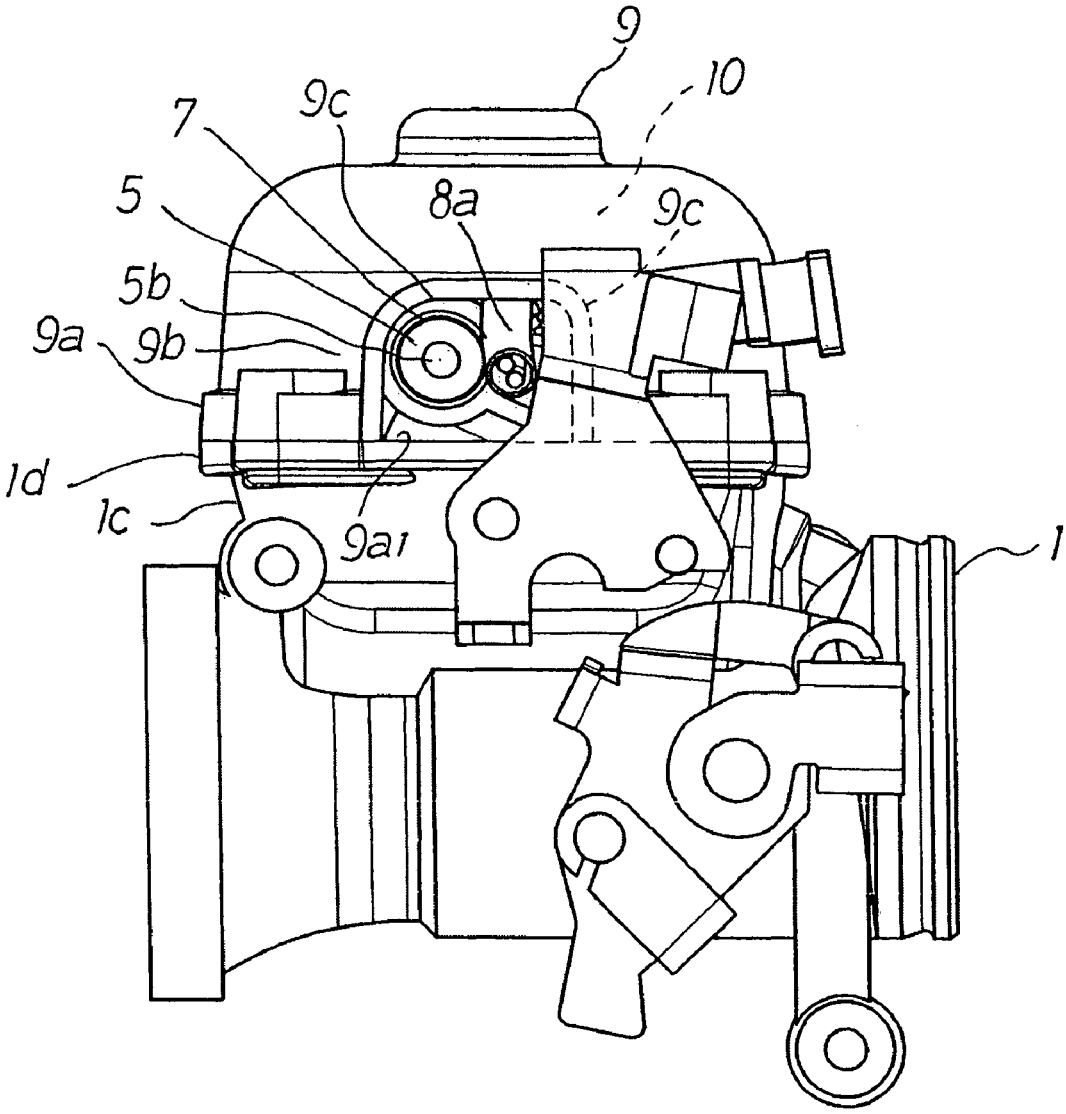
FIG. 2 is a side view of FIG. 1.
Figure 3:
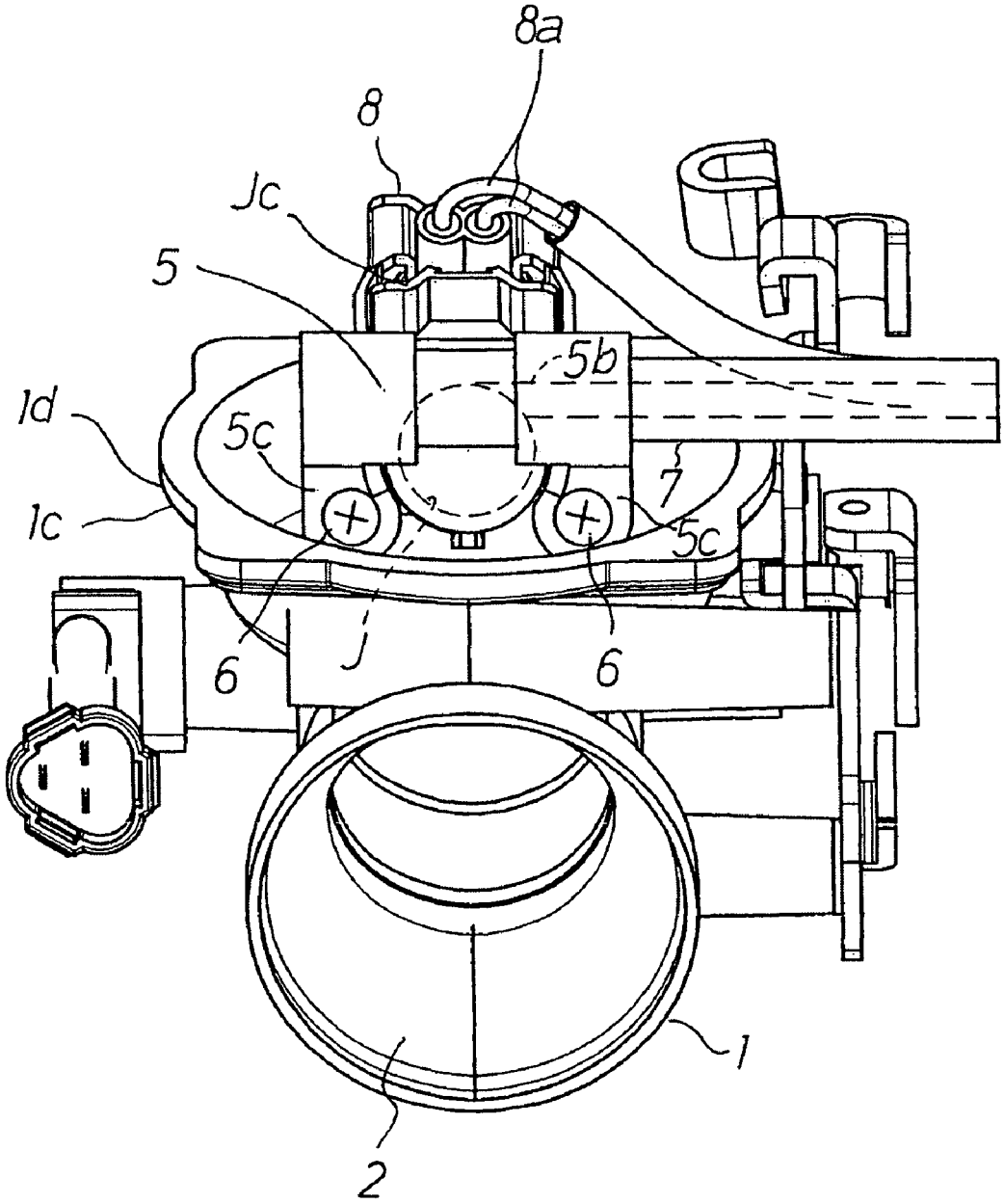
FIG. 3 is a perspective view in a state in which an upper cup is detached in FIG. 1.

FIG. 1 is a longitudinal sectional view in a longitudinal direction of a suction air passage. FIG. 2 is a side view of FIG. 1, (a side view as seen from a back side of a paper surface in FIG. 1). FIG. 3 is a perspective view in a state in which an upper cup is detached.

Figure 5:
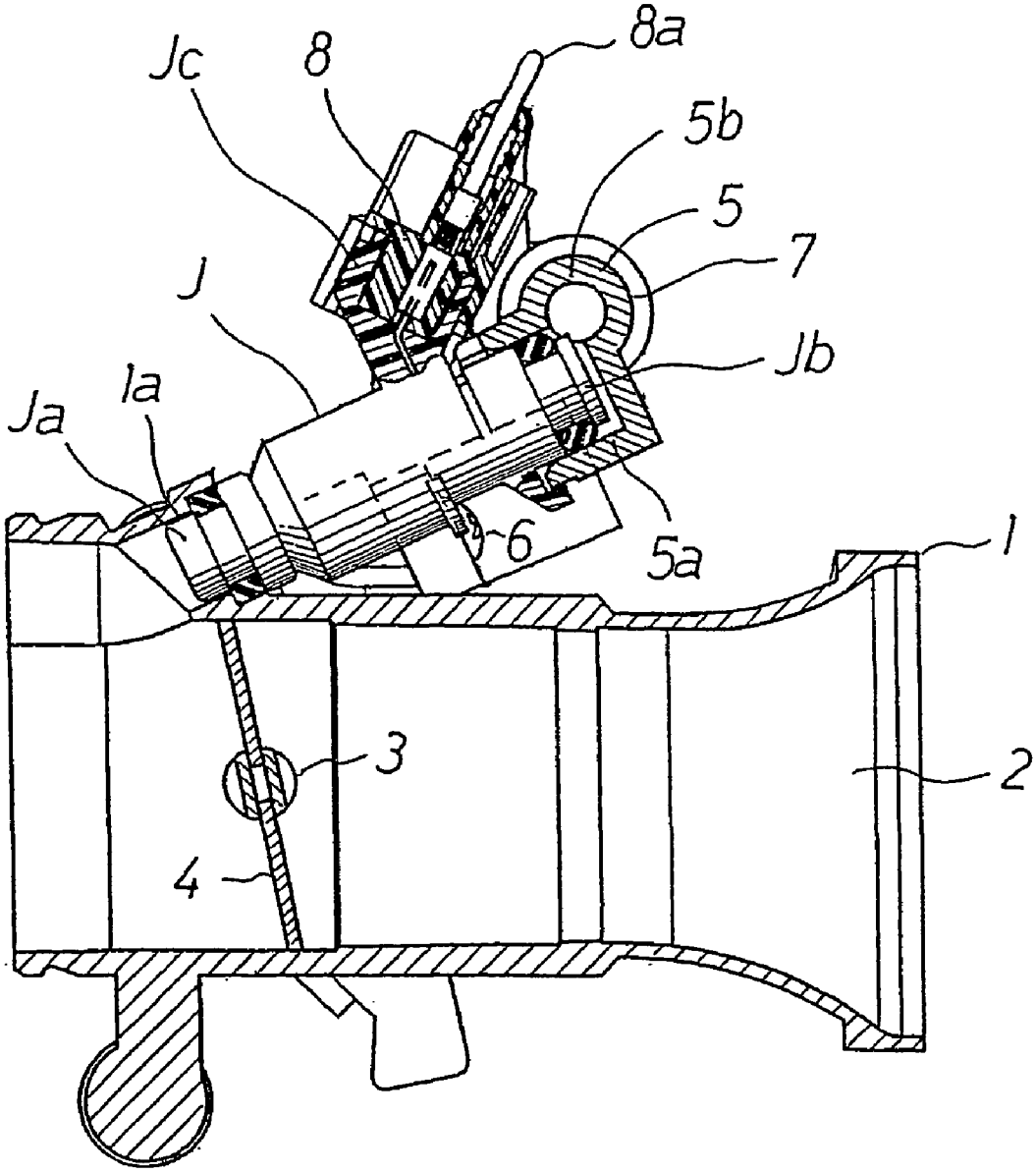
FIG. 5 PRIOR ART
FIG. 5 is a longitudinal sectional view in a longitudinal direction of a suction air passage showing a conventional throttle body.

In this case, the same reference numerals are attached to the same elements as those in FIG. 5, and a description thereof will be omitted.

A fuel injection valve J is supported by being inserted to an injection valve support hole 1*a* of a throttle body 1 and an injection valve support hole 5*a* of a fuel distribution pipe 5 in the same manner as the conventional valve, and is pinched by the throttle body 1 and the fuel distribution pipe 5.

Further, an external connecting connector Jc of the fuel injection valve J is fitted and connected to a female type connector 8 provided with a lead wire 8*a*.

A closed-end cup-shaped lower cup 1*c* open toward an upper side is integrally formed in an upper side wall 1*b* of the throttle body 1.

The lower cup 1*c* is formed in a cup shape so as to surround the fuel injection valve J, and an upper attaching collar portion 1*d* is formed in an upper end thereof in a circumferential direction.

A structure that the lower cup 1*c* surrounds the fuel injection valve J means a structure that the fuel injection valve J is arranged within an upper opening of the lower cup 1*c* at a time of viewing the lower cup 1*c* from an upper side in FIG. 1. At this time, in the present embodiment, the fuel distribution pipe 5 including a fuel introduction pipe 7 to a which fuel inflow side rear end portion Jb of the fuel injection valve J is inserted and the female type connector 8 including the lead wire 8*a* fitted and connected to the external connecting connector Jc are arranged so as to protrude to an upper side from the upper attaching collar portion 1*d* of the lower cup 1*c*. Reference numeral 9 denotes a closed-end cup-shaped upper cup which is arranged on the upper attaching collar portion 1*d* of the lower cup 1*c*, and in which a lower side is open by a lower attaching collar portion 9*a*. Further, the lower attaching collar portion 9*a* of the upper cup 9 is arranged on the upper attaching collar portion 1*d* of the lower cup 1*c*, and the lower attaching collar portion 9*a* is screwed toward the upper attaching collar portion 1*d* in this state. In accordance with this structure, a sealed receiving chamber 10 is formed by the lower cup 1*c* and the upper cup 9.

On the other hand, a takeout groove 9*c* is provided in a side wall 9*b* of the upper cup 9, and the takeout groove 9*c* is open toward a lower end surface 9*a*1 of the lower attaching collar portion 9*a*.

The takeout groove 9*c* is formed in a groove shape for inserting at least the fuel introduction pipe 7 and the lead wire 8*a* therethrough. In other words, the takeout groove 9*c* is provided by being notched toward an upper side from the lower end surface 9*a*1 of the lower attaching collar portion 9*a*.

The takeout groove 9*c* is well shown in FIG. 2.

A description will be given here of an assembly of the upper cup 9.

First, the fuel injection valve J is pinched to the throttle body 1 by the fuel injection pipe 5 in the manner mentioned above so as to be fixed, and the female type connector 8 is fitted and connected to the external connecting connector Jc of the fuel injection valve J. In accordance with this structure, the fuel injection valve J including the fuel distribution pipe 5, the external connecting connector Jc and the female type connector 8 are arranged in an inner side of the opening of the lower cup 1*c*.

On the other hand, the fuel introduction pipe 7 connected to the fuel distribution pipe 5 and the lead wire 8*a* connected to the female type connector 8 are positioned in an upper side than the upper attaching collar portion 1*d* of the lower cup 1*c*, and extends toward the outer side from the lower cup 1*c*.

This state is clearly shown in FIG. 3.

Next, the lower attaching collar portion 9*a* of the upper cup 9 is arranged on the upper attaching collar portion 1*d* of the lower cup 1*c* in a contact manner. At this time, the fuel introduction pipe 7 and the lead wire 8*a* are arranged so as to be inserted into the takeout groove 9*c* provided in the side wall 9*b* of the upper cup 9, and the lower attaching collar portion 9*a* of the upper cup 9 is fixed by screw onto the upper attaching collar portion 1*d* of the lower cup 1*c* in this state.

In accordance with the structure mentioned above, the sealed receiving chamber 10 is formed by the lower cup 1*c* and the upper cup 9, the fuel injection valve J including the fuel distribution pipe 5, the external connecting connector Jc and the female type connector 8 are arranged so as to be received within the receiving chamber 10, and the fuel introduction pipe 7 and the lead wire 8*a* are drawn out toward the external portion from the receiving chamber 10 via the takeout groove 9*c*.

In this case, a fuel pipe (not shown) communicating with a fuel pump (not shown) is connected to the fuel introduction pipe 7 drawn out to the external portion, and the lead wire 8*a* is electrically connected to an ECU (not shown).

Accordingly, the fuel boosted by the fuel pump is supplied to the fuel injection valve J from the fuel pipe via the fuel introduction pipe 7 and the fuel distribution pipe 5, and an electric signal output from the ECU is supplied to an electromagnetic coil within the fuel injection valve J via the lead wire 8*a*, the female type connector 8 and the external connecting connector Jc.

In accordance with the throttle body having the structure mentioned above, since the fuel injection valve J, the fuel distribution pipe 5 to which the fuel inflow side rear end portion Jb of the fuel injection valve J is inserted and the female type connector 8 fitted and connected to the external connecting connector Jc are arranged so as to be received within the receiving chamber 10 formed by the lower cup 1*c* and the upper cup 9, no obstacle is directly brought into contact with the throttle body at a time when the vehicle runs or the vehicle is fallen down.

Accordingly, it is possible to largely improve a freedom of layout of the throttle body, and it is possible to select the layout for an extremely short time.

This structure is effective, particularly in a two-wheeled vehicle and a general purpose machine in which the throttle body is arranged so as to be directly exposed to the external.

Further, since the external connecting connector Jc and the female type connector 8 is arranged within the receiving chamber 10, it is possible to inhibit water, mud or the like from being attached to the fitted and connected portion therebetween, and it is possible to maintain a stable electric connection for a long time period.

Further, since the fuel injection valve J is arranged within the receiving chamber 10, it is possible to inhibit the drive sound generated in the fuel injection valve J from leaking toward the external, and it is possible to reduce the fatigue of the driver.

Further, since the lower cup 1*c* forming the receiving chamber 10 and the throttle body 1 are integrally formed, it is possible to inhibit an increase of the number of the parts, and it is possible to reduce a manufacturing cost.

Further, since the shape of the receiving chamber 10 receiving the fuel injection valve J and the like is formed in a similar outer appearance (cylindrical shape) to a fixed vacuum type carburetor, the structure is preferable as the throttle body for the two-wheeled vehicle in which a retro outer appearance is preferred.

Further, since the fuel introduction pipe 7 and the lead wire 8*a* can be inserted into the takeout groove 9*c* via the opening of the lower end surface 9*a*1 of the upper cup 9 at a time of assembling the upper cup 9 to in the lower cup 1*c*, it is possible to easily take the fuel introduction pipe 7 and the lead wire 8*a* out of the receiving chamber 10, and it is possible to improve an assembling property and a maintenance property of the fuel distribution pipe 5 and the female type connector 8.

Figure 4:
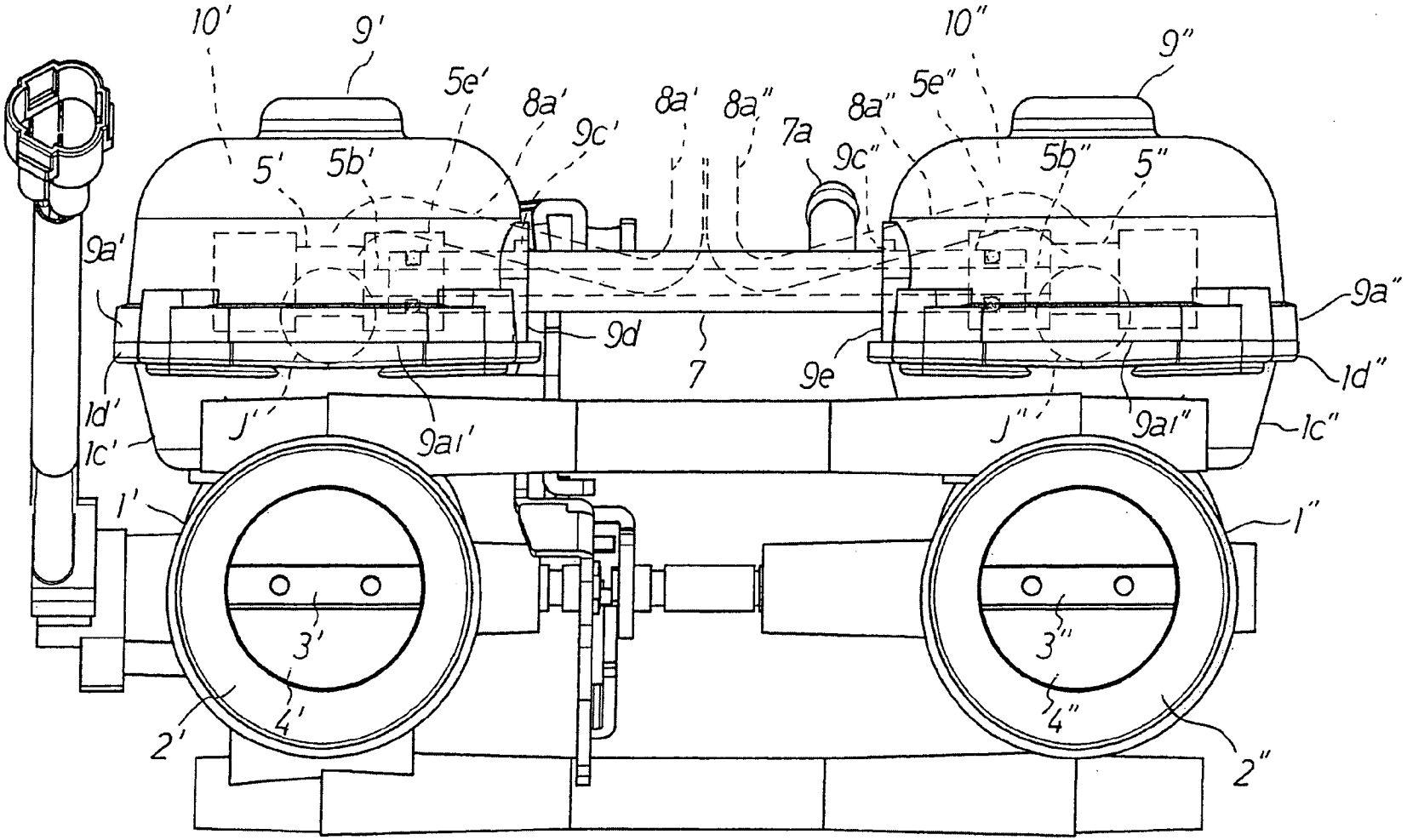
FIG. 4 is a front view showing another embodiment of the throttle body in the fuel injection apparatus in accordance with the present invention.

Next, FIG. 4 shows an embodiment of a multiple throttle body in which a plurality of single throttle bodies 1 are arranged side by side.

In the present embodiment, two throttle bodies 1 shown in FIG. 1 are arranged side by side portion so as to make longitudinal axes of the throttle valve shafts 3 coaxial.

In this case, in order to make an explanation easy, a left throttle body in FIG. 4 is called as a first throttle body 1' and a term "first" is attached to constituting parts used therein.

For example, reference numeral 5' denotes a first fuel distribution pipe.

Further, a right throttle body in FIG. 4 is called as a second throttle body 1", and a term "second" is attached to constituting parts used therein.

For example, reference numeral 5" denotes a second fuel distribution pipe.

A first fuel injection valve J' is arranged within a first receiving chamber 10' of the first throttle body 1' so as to be fixed to the first throttle body 1' by a first fuel distribution pipe 5', and a first female type connector 8' is further fitted and connected to a first external connecting connector Jc' (the first external connecting connector Jc' and the fist female connector 8' are not illustrated).

A second fuel injection valve J" is arranged within a second receiving chamber 10" of a second throttle body 1" so as to be fixed to a second throttle body 1" by a second fuel distribution pipe 5", and a second female type connector 8" is further fitted and connected to a second external connecting connector Jc" (the second external connecting connector Jc" and the second female connector 8" are not illustrated). Further, a first fuel introduction pipe insertion hole 5*e*' communicating with a first fuel distribution pipe 5*b*' is open toward a right end surface of the first fuel distribution pipe 5'.

Further, a second fuel introduction pipe insertion hole 5*e*" communicating with a second fuel distribution pipe 5*b*" is open toward a left end surface of the second fuel distribution pipe 5".

Further, an end portion of a linear fuel introduction pipe 7 provided with an inflow path 7*a* is arranged so as to be inserted toward the first fuel introduction pipe insertion hole 5*e*' and the second fuel introduction pipe insertion hole 5*e*".

In this case, the fixing of each of the fuel injection valves J' and J" to each of the throttle bodies 1' and 1" by each of the fuel distribution pipes 5' and 5" and the fixing and connecting between each of the external connecting connectors Jc' and Jc" and each of the female type connectors 8' and 8" are executed before the assembly of each of the upper cups 9' and 9". At this time, the fuel introduction pipe 7 protrudes toward the right side from the first fuel introduction pipe 5' of the first throttle body 1', and reaches to the second fuel introduction pipe 5" of the second throttle body 1". Further, the first lead wire 8*a*' extends toward the right side from the first fuel throttle body 1', and the second lead wire 8*a*" extends toward the left side from the second throttle body 1".

On the other hand, a first takeout groove 9*c*' is formed in facing side walls 9*d* (a right side wall 9*d*) of the first upper cup 9' in a notched shape toward a first lower end surface 9*a*'.

Further, a second takeout groove 9*c*" is formed in facing side walls 9*e* (a left side wall 9*e*) of the second upper cup 9" in a notched shape toward a second lower end surface 9*a*1".

Further, a first lower attaching collar portion 9*a*' of the first upper cup 9' is arranged in a contact manner toward an upper attaching collar portion 1*d*' of a first lower cup 1*c*'.

In accordance with the structure mentioned above, a first receiving chamber 10' is formed by the first lower cup 1*c*' and the first upper cup 9', the first fuel injection valve J' provided with the first fuel distribution pipe 5, and the first female type connector 8' fitted and connected to the first external connecting connector Jc' are arranged so as to be received within the first receiving chamber 10', and the fuel introduction pipe 7 and the first lead wire 8*a*' are taken out to the right outer side from the first takeout groove 9*c*'.

Further, a second lower attaching collar portion 9*a*" of the second upper cup 9" is arranged in a contact manner toward the second upper attaching collar portion 1*d*" of the second lower cup 1*c*".

In accordance with the structure mentioned above, a second receiving chamber 10" is formed by the second lower cup 1*c*" and the second upper cup 9", the second fuel injection valve J" provided with the second fuel distribution pipe 5" and the second female type connector 8" fitted and connected to the second external connecting connector Jc" are arranged so as to be received within the second receiving chamber 10", and the fuel introduction pipe 7 and the second lead wire 8*a*" are taken out to the left outer side from the second takeout groove 9*c*".

As described above, in accordance with the structure in which the takeout grooves 9*c*' and 9*c*" are provided in the facing side walls 9*d* and 9*e* facing to each other of the upper cups 9' and 9", in the multiple throttle body where a plurality of throttle bodies are arranged side by side, it is possible to use the linear single pipe as the fuel introduction pipe 7 and it is possible to wire each of the lead wires 8*a*' and 8*a*" toward the ECU by collecting in one set between both the throttle bodies 1' and 1". Accordingly, it is possible to achieve a space saving in the arrangement of the fuel pipe and the lead wire.

What is claimed is:

1. A throttle body in a fuel injection apparatus in which an injection side leading end portion of a fuel injection side leading end portion of a fuel injection valve provided with an external connecting connector is arranged so as to be inserted into an injection valve support hole of the throttle body, a fuel inflow side rear end portion of the fuel injection valve is arranged so as to be inserted into an injection valve support hole of a fuel distribution pipe connected to a fuel introduction pipe, said fuel injection valve is pinched by the throttle body and the fuel distribution pipe, and a female type connector provided with a lead wire connected to an external power source is fitted and connected to an external connecting connector of the fuel injection valve, wherein a closed-end cup-shaped lower cup surrounding the fuel injection valve and open to an upper side having an upper attaching collar portion is integrally provided in one side of the throttle body, and a closed-end cup-shaped upper cup open to a lower side having a lower attaching collar portion is arranged on said upper attaching collar portion in a contact manner, wherein the fuel injection valve including the female type connector fitted and connected to the external connecting connector and the fuel distribution pipe provided with a fuel introduction pipe are arranged so as to be received within a receiving chamber formed by said lower cup and the upper cup, and the fuel introduction pipe and a lead wire connected to said female type connector are arranged at a position above the upper attaching collar portion of the lower cup, and wherein said lead wire and the fuel introduction pipe are drawn out of the receiving chamber via a takeout groove which is arranged in a side wall of the upper cup and formed in a notched shape open toward a lower end face of the lower attaching collar portion.

2. A throttle in a fuel injection apparatus as claimed in claim 1, wherein a plurality of said throttle bodies are arranged side by side, and said takeout grooves are open to opposing side walls of the upper cups of adjacent throttle bodies.

* * * * *